US008668015B2

(12) United States Patent
Leeb

(10) Patent No.: US 8,668,015 B2
(45) Date of Patent: Mar. 11, 2014

(54) DUAL CHECK VALVE

(76) Inventor: Gerald Leeb, Gwynne (CA)

( * ) Notice: Subject to any disclaimer, the term of this patent is extended or adjusted under 35 U.S.C. 154(b) by 54 days.

(21) Appl. No.: 12/615,068

(22) Filed: Nov. 9, 2009

(65) Prior Publication Data

US 2010/0116503 A1 May 13, 2010

Related U.S. Application Data

(63) Continuation of application No. 11/725,688, filed on Mar. 19, 2007, now abandoned.

(30) Foreign Application Priority Data

Mar. 17, 2006 (CA) ..... 2540499

(51) Int. Cl.
*E21B 34/08* (2006.01)

(52) U.S. Cl.
USPC ..... 166/325; 137/512.3; 137/538

(58) Field of Classification Search
USPC ..... 137/512.1–512.3, 538, 542.23; 166/320, 321, 325, 326, 332.3; 175/218
See application file for complete search history.

(56) References Cited

U.S. PATENT DOCUMENTS

| | | | | |
|---|---|---|---|---|
| 531,304 | A | | 12/1894 | Dousman |
| 2,737,199 | A | | 3/1956 | Ingram |
| 2,771,091 | A | | 11/1956 | Baker et al. |
| 3,289,694 | A | | 12/1966 | Frye |
| 3,331,385 | A | * | 7/1967 | Taylor ..... 137/327 |
| 3,533,430 | A | | 10/1970 | Fredd |
| 3,603,394 | A | | 9/1971 | Raulins |
| 3,743,015 | A | | 7/1973 | Mott |
| 3,749,119 | A | | 7/1973 | Tausch et al. |
| 3,777,779 | A | | 12/1973 | Schwaller |
| 3,965,980 | A | | 6/1976 | Williamson |
| 4,049,015 | A | | 9/1977 | Brown |
| 4,064,937 | A | | 12/1977 | Barrington |
| 4,113,012 | A | | 9/1978 | Evans et al. |

(Continued)

FOREIGN PATENT DOCUMENTS

| | | |
|---|---|---|
| CA | 2266809 | 3/1999 |
| CA | 2318323 | 5/2000 |

OTHER PUBLICATIONS

"Bakerline's new approach to downhole blow-out prevention", Bakerline brochure published at least as early as May 2001, Bakerline, San Antonio, Texas.

*Primary Examiner* — Kenneth L Thompson
*Assistant Examiner* — Kipp Wallace
(74) *Attorney, Agent, or Firm* — Pedersen and Company, PLLC; Ken J. Pedersen; Barbara S. Pedersen

(57) ABSTRACT

A check valve comprising a section of a drill string, a flapper valve positioned within and concentric to the section of the drill string, and a piston valve positioned within and concentric to the section of the drill string. The flapper valve allows fluid flow in a first direction through an inner portion of a cross-section of the section of the drill string and not allowing fluid flow in a second direction, and the piston check valve allowing fluid flow in the first direction through an outer portion of the cross-section of the section of the drill string and not allowing fluid flow in the second direction, where the first portion and the second portion of the cross-section of the section of the drill string are mutually exclusive.

7 Claims, 5 Drawing Sheets

(56) References Cited

U.S. PATENT DOCUMENTS

| | | | | | |
|---|---|---|---|---|---|
| 4,128,108 | A | * | 12/1978 | Parker et al. | 137/327 |
| 4,248,264 | A | | 2/1981 | Hadsell et al. | |
| 4,262,693 | A | | 4/1981 | Giebeler | |
| 4,270,610 | A | | 6/1981 | Barrington | |
| 4,324,293 | A | | 4/1982 | Hushbeck | |
| 4,354,554 | A | | 10/1982 | Calhoun et al. | |
| 4,445,571 | A | | 5/1984 | Hushbeck | |
| 4,617,959 | A | | 10/1986 | Yamada | |
| 4,658,905 | A | * | 4/1987 | Burge | 166/373 |
| 4,749,037 | A | | 6/1988 | Christensen | |
| 4,779,688 | A | | 10/1988 | Baugh | |
| 4,811,758 | A | | 3/1989 | Piper | |
| 4,899,837 | A | | 2/1990 | Baugh | |
| 4,955,949 | A | | 9/1990 | Bailey et al. | |
| 4,962,819 | A | | 10/1990 | Bailey et al. | |
| 5,062,481 | A | | 11/1991 | Gullett | |
| 5,205,325 | A | | 4/1993 | Piper | |
| 5,509,442 | A | | 4/1996 | Claycomb | |
| 5,673,751 | A | | 10/1997 | Head et al. | |
| 5,819,852 | A | | 10/1998 | Cunningham et al. | |
| 6,273,195 | B1 | | 8/2001 | Hauck et al. | |
| 6,289,911 | B1 | | 9/2001 | Majkovic | |
| 6,296,059 | B1 | | 10/2001 | Leeb et al. | |
| 6,571,876 | B2 | | 6/2003 | Szarka | |
| 6,640,824 | B2 | | 11/2003 | Majkovic | |
| 6,662,886 | B2 | | 12/2003 | Russell | |
| 6,772,790 | B2 | | 8/2004 | Viebahn et al. | |
| 6,892,816 | B2 | | 5/2005 | Pringle et al. | |
| 7,114,516 | B2 | | 10/2006 | Ito | |
| 2002/0170602 | A1 | | 11/2002 | Fetterman, Jr. | |
| 2003/0127541 | A1 | * | 7/2003 | Marino | 239/539 |
| 2007/0215356 | A1 | | 9/2007 | Leeb | |

* cited by examiner

DUAL CHECK VALVE

This application is a continuation of U.S. Non-Provisional patent application Ser. No. 11/725,688, entitled "Dual Check Valve" and published as U.S. Patent Application Publication No. 2007/0215356, filed on Mar. 19, 2007, now abandoned which claims priority of Canadian Application No. 2,540,499, filed Mar. 17, 2006.

BACKGROUND

A check valve is designed to open under certain pressure conditions, and close under others. Check valves are often used in tubing strings for applications such as drilling, fishing, and completing bottom hole assemblies to prevent hydrocarbons or unwanted fluids from flowing back up the tubing string. Examples of these types of valves are models "FC", "F", "GC" and "G" drill pipe float valves produced by Bakerline of San Antonio, Tex. A disadvantage with these check valves is that they limit flow through them for a given pressure. Under some circumstances, this could result in a downhole motor stalling.

SUMMARY

There is provided a check valve that allows increased flow through the valve, comprising a housing, such as a section of a drill string, a first check valve, and a second check valve. The first check valve and second check valve are oriented to provide flow paths in parallel, either in the same direction or in opposed directions. The second check valve is at least partly within the first check valve. The first check valve is positioned within the housing and in one embodiment may be concentric to the housing. The second check valve is positioned within and in one embodiment may be concentric to the housing and in some embodiments may be wholly within the first check valve. In some embodiments, each of the first check valve and the second check valve may be selected from a group consisting of a flapper valve, a piston valve, a ball valve or a poppet valve. One or both the first check valve and the second check valve may be biased closed by for example a spring or fluid pressure and the housing may comprise a port to apply fluid pressure. Surfaces that redirect abrasive flows within the first and second check valves may be tapered surfaces.

In an embodiment, the second check valve is positioned within an inner wall of the housing, the second check valve having an annular shape, and the first check valve is positioned within the annular shape wall of the second check valve.

In another embodiment, the first check valve opens to allow fluid flow in the first direction when fluid pressure above a first threshold is applied, and the second valve opens to allow fluid flow in the first direction when a fluid pressure above a second threshold that is higher than the first threshold is applied.

BRIEF DESCRIPTION

There will now be given a brief description of a dual check valve, by reference to the drawings, by way of illustration only, and in which.

DESCRIPTION

Figure 1:
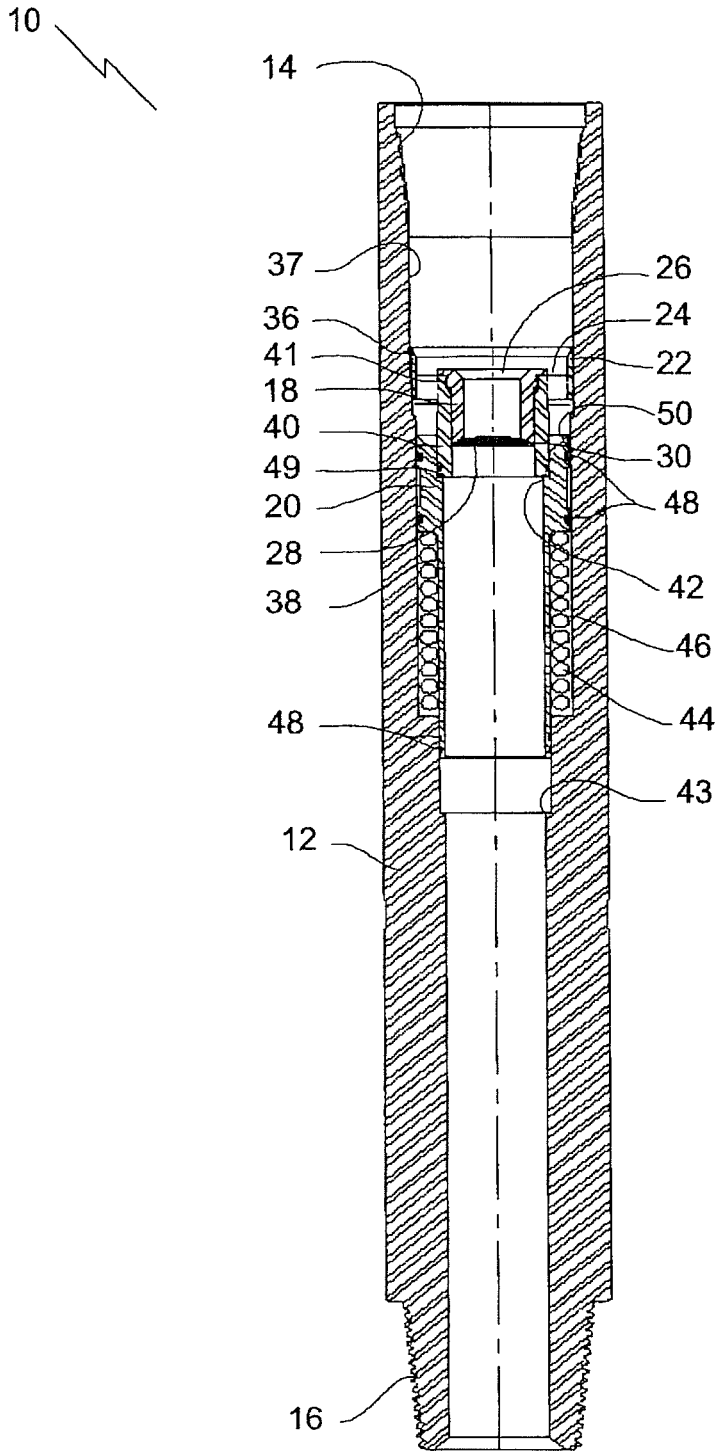
FIG. 1 is a side view in section of a drill string section with the check valve.

Referring to FIG. 1, the check valve referred to generally by reference numeral 10 is shown to include a section of drill string 12 that acts as a housing for the check valve 10. While a section of drill string 12 is described in relation to the embodiments described below, it will be recognized that the check valve 10 may also be used with other suitable housings. The drill string section 12 is inserted in a drill string using an upper rotary connection 14 and lower rotary connection 16. Within drill string section 12 are two individual check valves: an outer or first check valve 20 and an inner or second check valve 18. The check valves 20 and 18 are both positioned within the drill string section 12 to provide flow paths in parallel, such that each allows flow in the same or opposite directions, but each allows fluid flow, whether gas, liquid or slurry, through a different and separate portion of the cross-section of the drill string section 12. The check valves 20 and 18 may be concentric, but also may be offset from each other within the drill string section 12 The first check valve 20 has in one embodiment an annular shape, such that the second check valve 18 is positioned wholly or partly within the first check valve 20. Thus, the first check valve allows fluid flow through an outer portion of the cross-section of the drill string section 12, and the second check valve 18 allows flow through the center portion of the cross-section. This can be seen by referring to FIG. 4, the upper piston 22 of first check valve 20 is shown, where the upper piston has outer openings 24 corresponding to flow through first check valve 20, and a central opening 26 corresponding to flow through the second check valve 18. As two check valves 18 and 20 are used, the pressure threshold to open the valves may be set at different values, such that one opens before the other. For example, at lower pressures, only the second valve 18 may open, but under increased pressure, the first check valve 20 would open to increase the flow through check valve 10. Alternatively, the first valve 20 may open at a lower pressure threshold and allow the fluid to bypass the second valve 18.

Referring to FIG. 1, the check valve referred to generally by reference numeral 10 is shown to include a section of drill string 12 that acts as a housing for the check valve 10. While a section of drill string 12 is described in relation to the embodiments described below, it will be recognized that the check valve 10 may also be used with other suitable housings. The drill string section 12 is inserted in a drill string using an upper rotary connection 14 and lower rotary connection 16. Within drill string section 12 are two individual check valves: an outer or first check valve 20 and an inner or second check valve 18. The check valves 20 and 18 are both positioned within the drill string section 12 to provide flow paths in parallel, such that each allows flow in the same or opposite directions, but each allows fluid flow, whether gas, liquid or slurry, through a different and separate portion of the cross-section of the drill string section 12. The check valves 20 and 18 may be concentric, but also may be offset from each other within the drill string section 12. The first check valve 20 has in one embodiment an annular shape, such that the second check valve 18 is positioned wholly or partly within the first check valve 20. Thus, the first check valve allows fluid flow through an outer portion of the cross-section of the drill string section 12, and the second check valve 18 allows flow through the center portion of the cross-section. This can be seen by referring to FIG. 4, the upper piston 22 of first check valve 20 is shown, where the upper piston has outer openings 24 corresponding to flow through first check valve 20, and a central opening 26 corresponding to flow through the second check valve 18. As two check valves 18 and 20 are used, the pressure threshold to open the valves may be set at different values, such that one opens before the other. For example, at lower pressures, only the second valve 18 may open, but under increased pressure, the first check valve 20 would open to increase the flow through check valve 10. Alternatively, the first valve 20 may open at a lower pressure threshold and allow the fluid to bypass the second valve 18.

Figure 5:
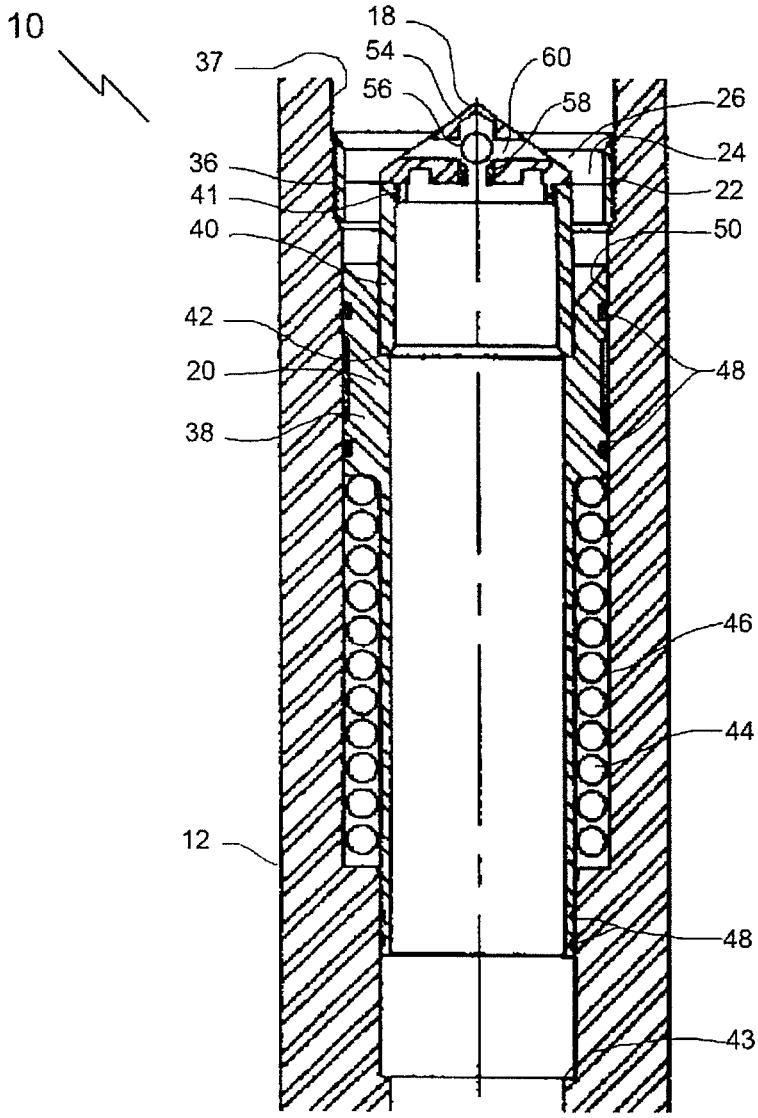
FIG. 5 is a detailed side view in section of a drill string section with an alternative check valve.

First and second check valves 20 and 18 can be any suitable type of check valve, such as flapper valves, piston valves, ball valves, poppet valves, etc. In the embodiment depicted in FIG. 1, the second check valve 18 is a flapper valve and first check valve is a piston valve, but it will be apparent to those skilled in the art that substitutions may be made. In addition, it will be apparent that the orientation of check valve 10 may be reversed to allow flow in the opposite direction, or first and second check valves 20 and 18 may be oriented in opposite directions relative to one another. This arrangement allows a certain amount of flow in each direction, based on the size of the check valves, and may be useful for testing and other purposes. This is shown in FIG. 5, where second check valve 18 is a ball valve 54 made up of a ball 56 and a seat 58, with flow channels 60 through ball valve 54. In the embodiment depicted, second check valve 18 is forced close by pressure in the direction that first check valve 20 opens, and opens under the opposite direction of flow.

Figure 3:
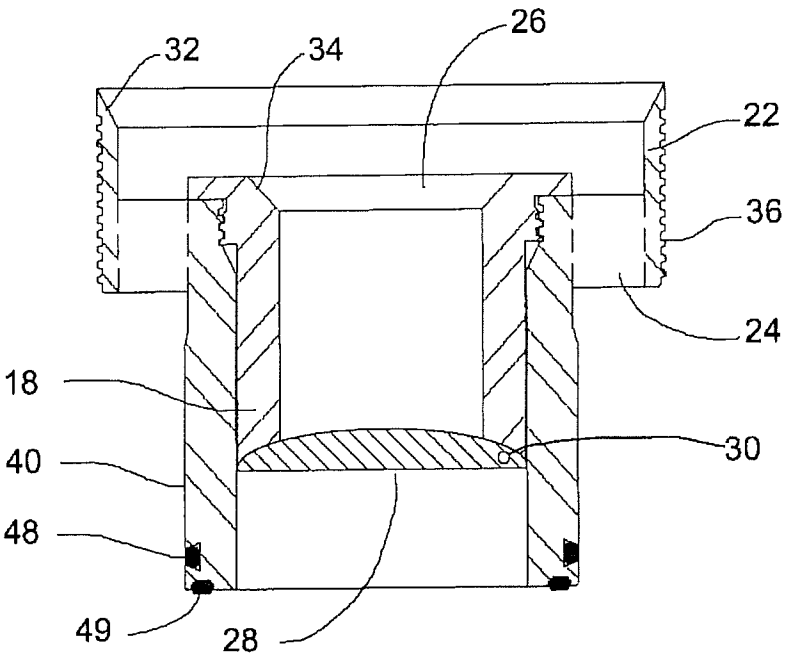
FIG. 3 is a detailed side view in section of the first check valve.
Figure 4:
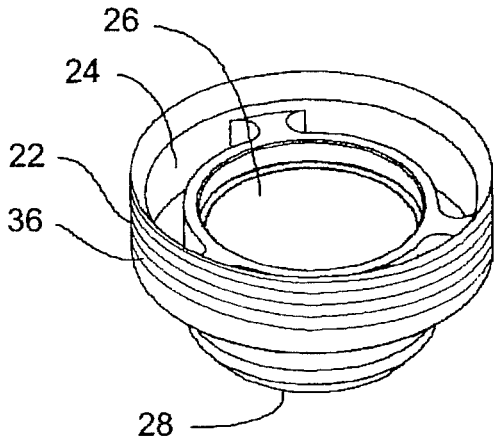
FIG. 4 is a perspective view of the upper piston.

Referring to FIG. 3, the second check valve 18 includes a flapper 28 positioned at the bottom of the second check valve 18. Flapper 28 is biased in the closed position by a spring (not shown) at the hinge 30. In this embodiment, the second check valve 18 is integrally formed with the upper piston 22 of the second check valve 18, as both upper piston 22 and second check valve 18 are designed to remain stationary. It will be understood that a connection between the two may be provided, such as a threaded connection or otherwise. Referring to FIG. 4, an embodiment is shown where the second check valve 18 is not integrally formed with the upper piston 22. The fluid applies pressure to the flapper 28 through the central opening 26. Once the pressure is great enough to overcome the spring, flapper 28 opens and permits the fluid to flow. Surfaces 32 and 34 of the upper piston 22 are tapered to reduce the effects of the flow of an abrasive fluid. Referring to FIG. 1, the second check valve 18 is installed within the drill string section 12 by threads 36 on upper piston 22 which engage the inner wall 37.

Figure 6:
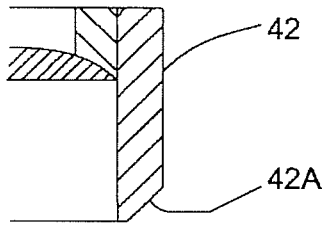
FIG. 6 shows a tapered seal for a bottom end of the inner check valve of FIG. 3.

Referring to FIG. 1, first check valve 20 includes the upper piston 22, a lower piston 38, and an inner sleeve 40 that is attached to the bottom of the upper piston 22 by threads 41 to hold it stationary. The lower piston 38 is positioned against the inner wall 37 of the drill string section 12, such that it is free to move axially. The axial movement of lower piston 38 is limited by contact with a shoulder 42 inside lower piston 38 and the bottom of inner sleeve 40 in one direction, and contact with a shoulder 43 on the inner wall 37 and the bottom of the lower piston 38 in the other direction. The lower piston 38 is biased toward the inner sleeve 40 by a spring 44 in a cavity 46 formed by the lower piston 38 and the inner wall 37 of the drill string section 12. The cavity 46 is sealed by o-ring seals 48 positioned on sections of the lower piston 38 above and below the cavity 46. An o-ring seal 48 positioned on the inner sleeve 40 is also used to seal the connection to the lower piston 38. Instead of, or in addition to o-ring seals 48 on the inner sleeve 40, there may be an o-ring seal 49 on the bottom of the inner sleeve 40. Alternatively, for example, a mating taper 42A shown in FIG. 6 may be used between the lower piston 38 and the inner sleeve 40. Instead of a spring 44, pressurized fluid may also be used to bias the lower piston 38 toward the upper piston 22 to form a positive seal with the inner sleeve 40. If a pressurized fluid is used, ports (not shown) through the drill string section 12 into the cavity 46 may be used to maintain or otherwise control the pressure. As fluid pressure overcomes the force of the spring 44, the lower piston will be pushed down until an opening is created between the inner sleeve 40 and the lower piston 38. The top surface 50 of the lower piston 38 is also tapered to reduce the effect of the flow of abrasive fluid through the first check valve 20. In addition, surfaces subject to the abrasive flow in both the second check valve 18 and the first check valve 20 may be hard coated, for example, with carbide. Other surfaces besides those shown may also be tapered to reduce the adverse effects of wear on the check valve 10.

Variations of the above embodiment include varying the components that are stationary and the components that reciprocate components. For example, the upper piston 22 may reciprocate with the lower piston 38 being stationary, and second check valve 18 may reciprocate or be held stationary. The check valve may be used in any application where a check valve can be used, as for example in oilfield applications.

Figure 7:
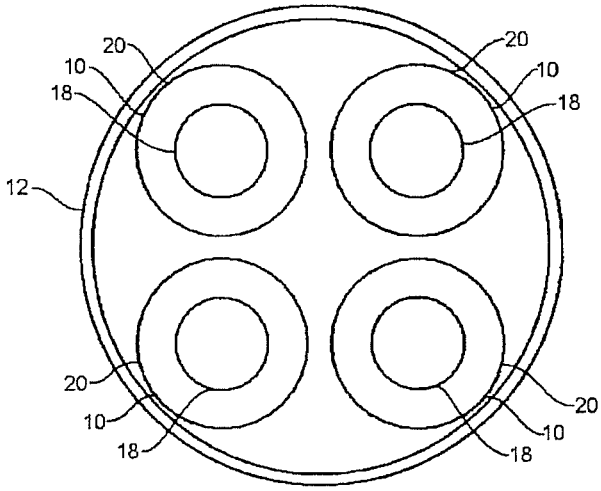
FIG. 7 shows a top plan view of multiple check valves within a drill string section.

In addition, referring to FIG. 7, multiple check valves 10 may be included within housing 12. Four check valves 10 are shown, however, the number may vary according to the demands of each situation. Each check valve may be different or the same, including the type of valve, the pressure at which each first and second valve 20 and 18 opens, the direction in which they open, and the amount of fluid allowed to flow past each valve 20 and 18. In a downhole application, this may be useful by allowing an operator to control downhole tools by changing the fluid pressure against check valves 10.

Figure 2:
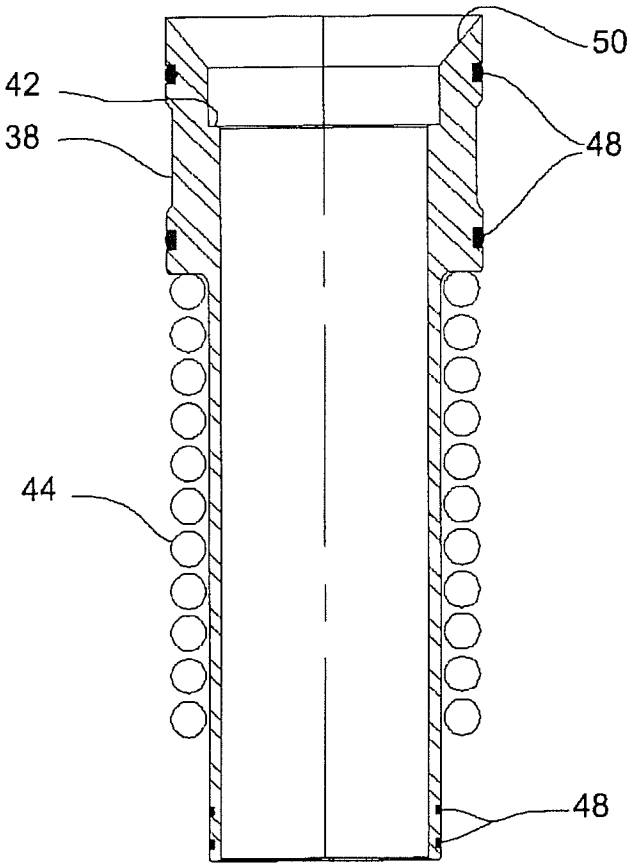
FIG. 2 is a detailed side view in section of the lower piston of the second check valve.

Check valve 10 is assembled by inserting the lower piston 38 with the spring 44 as shown in FIG. 2 into housing 12 as shown in FIG. 1. Referring to FIG. 3, the inner sleeve 40 is attached to upper piston 22, as well as the second check valve 18 if not integrally formed with it. Referring again to FIG. 1, upper piston is secured by threads 41 to the irmer wall 37 of housing 12. If the housing 12 is a drill string section, it may then be installed in a drill string and be used in downhole applications. The inner check valve 18 in for example the flapper embodiment or ball valve embodiment may be sheared off to allow tools to be run through it. This is achieved by having the inner valve 18 connected to the outer valve 20 with a connection that is shearable, such as by pins, threads or undercut grooves.

Immaterial modifications may be made to the embodiments described here without departing from what is defined by the claims.

What is claimed is:

1. A valve for use in a drill string, the valve comprising:

a housing having an inner wall;

a sleeve disposed within the housing with a gap between the inner wall and the sleeve, the gap having a width;

a first check valve positioned within the housing, the first check valve including a piston, the piston being axially movable between an open position in which the piston is outside the gap and a closed position in which a portion of the piston extends into the gap, the piston being biased to the closed position;

in which the piston includes an annular shoulder facing towards the sleeve, and in which, in the closed position, with the portion of the piston extending into the gap, the shoulder on the piston abuts against the sleeve outside of the gap;

the portion of the piston that extends into the gap having parallel sides and extending across the width of the gap in the closed position, and the parallel sides terminating in a tapered surface, the tapered surface in operation of the valve, redirecting abrasive flows in the gap when the first check valve is in the open position;

a second check valve positioned within the sleeve, the second check valve being positioned in parallel to the first check valve;

in which the first check valve and the second check valve are oriented to block flow in opposite directions; and in which the fluid flowing through the valve is contained entirely within the housing.

2. The valve of claim 1, wherein the second check valve is a ball valve.

3. The valve of claim 1 in which the first check valve and the second check valve are each positioned concentric to the housing.

4. A valve set comprising more than one valve according to claim 1 positioned within the housing, each valve comprising the first check valve and the second check valve, each valve being in parallel to each other valve in the valve set.

5. The valve of claim 1, wherein the piston is biased closed by a spring.

6. The valve of claim 1 in which the sleeve is threaded to the inner wall of the housing.

7. The valve of claim 1 in combination with a drill string in which the valve is inserted.

* * * * *